US005851013A

United States Patent [19]

Simons

[11] Patent Number: 5,851,013

[45] Date of Patent: Dec. 22, 1998

[54] BLOWOUT PREVENTER PACKING ELEMENT WITH METALLIC INSERTS

[75] Inventor: Stephen P. Simons, Kingwood, Tex.

[73] Assignee: Hydril Company, Houston, Tex.

[21] Appl. No.: 887,884

[22] Filed: Jul. 3, 1997

[51] Int. Cl.[6] ..... E21B 33/06

[52] U.S. Cl. ..... 277/327; 251/1.2; 277/651

[58] Field of Search ..... 251/1.1, 1.2; 277/324, 277/327, 651

[56] References Cited

U.S. PATENT DOCUMENTS

| | | | |
|---|---|---|---|
| 2,609,836 | 9/1952 | Knox . | |
| 3,323,773 | 6/1967 | Walker . | |
| 3,572,627 | 3/1971 | Jones et al. . | |
| 3,591,125 | 7/1971 | Lewis | 251/1 |
| 3,667,721 | 6/1972 | Vujasinovic . | |
| 4,098,516 | 7/1978 | Murman . | |
| 4,461,448 | 7/1984 | Huey et al. | 251/1 B |
| 4,605,195 | 8/1986 | Burton et al. | 251/1.2 |
| 5,064,164 | 11/1991 | Le . | |

*Primary Examiner*—Anthony Knight
*Assistant Examiner*—Gary Grafel
*Attorney, Agent, or Firm*—Rosenthal & Osha LLP

[57] ABSTRACT

A packing element for an annular blowout preventer includes an annular elastomeric body disposed about a longitudinal axis that is adapted to be compressively displaced inwardly towards the axis. A plurality of the metallic inserts are embedded in the body in generally circular fashion spaced apart in respective radial planes extending from the axis for reinforcing the body. Each of the inserts include upper and lower flanges, and a web element extending between the flanges. The web element includes leading and trailing edges, each having outer arcuate surfaces that are substantially semicircular in cross-section for distributing the loads applied to a bond line between the insert and the elastomeric body during the operation of the packing element. A central rib extends between the leading and trailing edges. The rib is thinner than the edges so that the web element exhibits a substantially dumbbell shaped cross section, somewhat similar to an I-beam construction, for efficient reinforcement of the elastomeric body. The shape of the web element increases the volume of the elastomeric body and decreases the volume of the metallic inserts in the packing element to reduce the loads applied to the bond line between the insert and elastomeric body.

3 Claims, 2 Drawing Sheets

FIG. 2
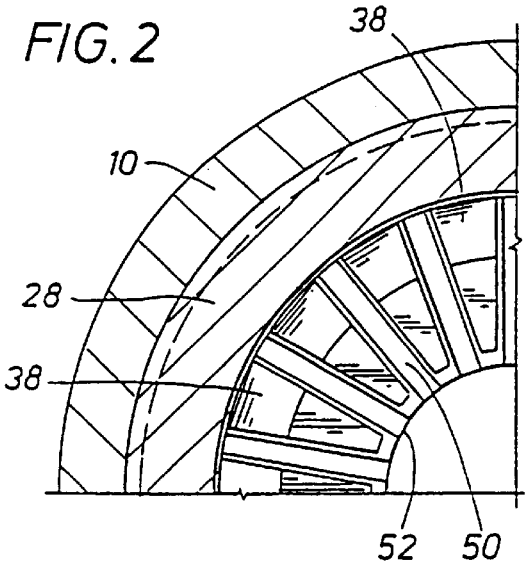
FIG. 3
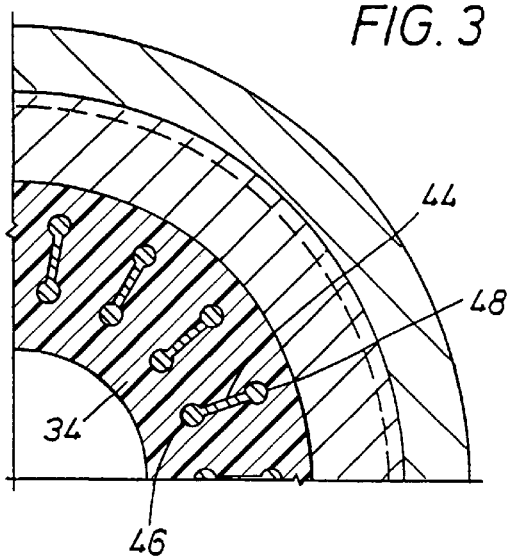
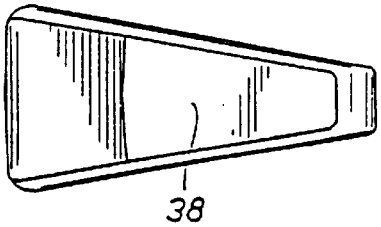
FIG. 5
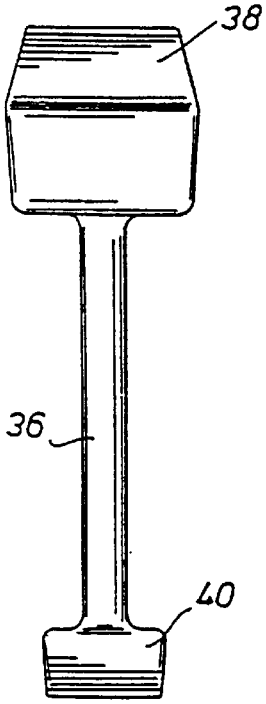
FIG. 6
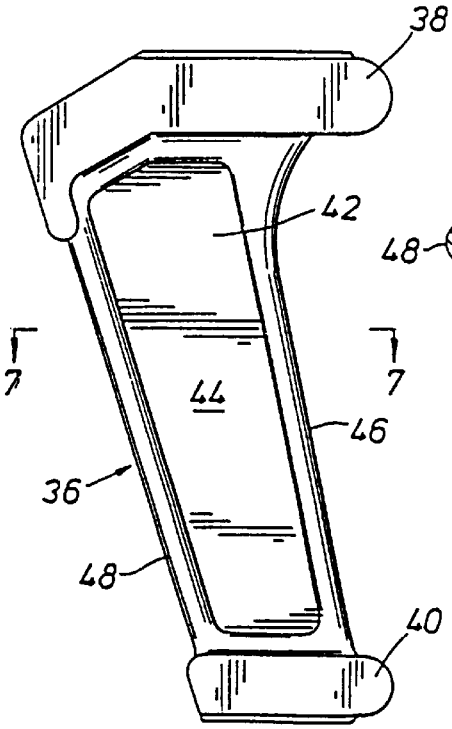
FIG. 4
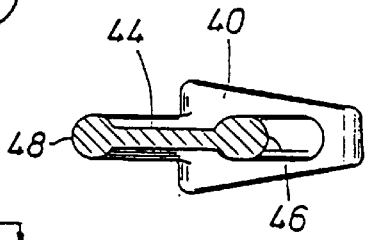
FIG. 7

BLOWOUT PREVENTER PACKING ELEMENT WITH METALLIC INSERTS

BACKGROUND OF THE INVENTION

1. Field of the Invention

The present invention relates to annular type blowout preventers and similar equipment used to control pressures in a drilling well, and more particularly to packer elements and inserts used in such equipment.

2. The Related Art

The use of packing elements, or packers, for sealing around drill pipes and other tubular goods extending into a drilling well, and in situations where no "work pipe" extends through the bore of the packing element, is well known. In the latter case, a packing element can be adapted for radial compression to such an extent that its bore is entirely closed, essentially acting as a variable aperture flow valve. In the case of sealing about a drill pipe, e.g., packing elements are typically used in blowout preventers in a "stand by" condition, from which the packer can instantly be compressed, either automatically by an increase in well pressure or manually, to effect a seal about the pipe to prevent the well from blowing out.

U.S. Pat. No. 2,609,836, assigned to Hydril Co., the assignee of the present invention, describes an annular type blowout preventer having a packing element that incorporates a plurality of like equally spaced metal inserts imbedded in a rubber body in a circular fashion about a central axis of the packer. The inserts provide structural support for the rubber material against the well pressure to which the packer is subjected. Upon compression of the packer about a drill pipe, or upon itself, the rubber body is squeezed radially inwardly which moves the inserts radially inwardly as well, but the inserts impose some resistance to the movement of the body at the bond line between the inserts and the body subjecting the rubber body to additional strain in the radial direction. The well pressure to which the packing element is exposed also exerts upward forces on the stretched and extended rubber body so that the body is subject to strain in the vertical direction as well. Such strains cause fatigue and weakening of the rubber material, particularly after repeated closures of the packer, thus limiting the useful life of the packing element and requiring that it be replaced after a limited number of loading cycles, i.e., closures.

In this regard, it has been observed that packers of the type disclosed in the '836 patent often experience premature failure at the bond line between the rubber body and the metallic insert. The sharp edges and wedge-like profiles of the rib portion of the inserts create areas of concentrated stress and strain at the interface of the rib with the rubber material. Once the bond line fails, the inserts become less capable of reinforcing the rubber, enabling greater relative movement between the inserts and the rubber body and the propagation of cracks initiating at the bond line throughout the rubber body that ultimately contribute to failure of the packer.

In an effort to increase the number of closures that a packing element can safely sustain without failure, U.S. Pat. No. 4,098,516, also assigned to Hydril Co., provides a metallic insert for a packing element that exhibits enhanced capabilities to "anchor" the insert to the rubber body to reduce the strain-inducing stretching of the rubber, and thus increase the life of the packer. Specifically, each of the inserts is provided with protruding lateral and upright "ribbing" on the rib or web portion of the inserts to provide additional surface area for bonding with the rubber body, in an effort to anchor the body against excessive vertical and horizontal displacement of the rubber. This modification was believed to cause a greater portion of the compressive load on the packer to be transferred to the metallic inserts than in inserts lacking the ribbing, whereby the resulting strain on the rubber body is reduced, and the useful life of the packer is increased.

In many cases, however, packers built in accordance with the '836 patent also experienced premature failure at the rubber/insert bond line. The increased volume of metal in the packing element, resulting from the protruding ribbing on the inserts, reduces the volume of rubber in the packing element. As a result, there is less rubber in the packer to bear the compressive loads applied to the packer in operation, and the rubber experiences increased stress and strain. These increases are greatest at the leading and trailing edges of the rib (web) since these edges still exhibit a relatively small surface area in the '516 patent.

It is therefore an object of the present invention to provide a metallic insert for use in a packing element wherein the leading and trailing edges of the insert exhibit a relatively large, arcuate surface area so as to reduce the stresses and strains developed at the bond line between the insert and the elastomeric body in the packer.

It is a further object of the present invention to provide such an insert that has a reduced volume of metal compared to conventional inserts so that the volume of the elastomeric body in the packer is increased for greater load bearing potential in the elastomer, whereby strains in the elastomer at its bond line with the inserts are reduced.

It is a still further object to provide such a reduced volume metallic insert having a dumbbell shaped cross-section, somewhat like an I-beam in construction, to provide efficient load bearing capabilities through the geometry of the insert.

SUMMARY

The objects described above, as well as other objects and advantages are achieved by a packing element for an annular blowout preventer, and more particularly, by the metallic inserts used within the packing element. The packing element includes an annular elastomeric body disposed about a longitudinal axis that is adapted to be compressively displaced inwardly towards the axis. A plurality of the metallic inserts are embedded in the body in generally circular fashion spaced apart in respective radial planes extending from the axis for reinforcing the body.

Each of the inserts include upper and lower flanges, and a web element extending between the flanges. The web element includes leading and trailing edges, each having outer arcuate surfaces that are substantially semicircular in cross-section for distributing the loads applied to a bond line between the insert and the elastomeric body during the operation of the packing element. A central rib extends between the leading and trailing edges. The rib is thinner than the edges so that the web element exhibits a substantially dumbbell shaped cross section, somewhat similar to an I-beam construction, for efficient reinforcement of the elastomeric body. The shape of the web element increases the volume of the elastomeric body and decreases the volume of the metallic inserts in the packing element to reduce the loads applied to the bond line between the insert and elastomeric body.

BRIEF DESCRIPTION OF THE DRAWINGS

In the drawings, wherein like reference characters are used throughout to describe like parts:

FIG. 2 is a sectional cut-away of the packing element and blowout preventer taken along section line 2—2 in FIG. 1;

FIG. 3 is a sectional cut-away of the packing element and blowout preventer taken along section line 3—3 in FIG. 1;

FIG. 4 is a side elevational view of a metallic insert in accordance with the present invention;

FIG. 5 is a plan view of the metallic insert;

FIG. 6 is an edge-wise elevational view of the metallic insert; and

FIG. 7 is a sectional view of the metallic insert taken along section line 7—7 of FIG. 4.

DETAILED DESCRIPTION OF THE PREFERRED EMBODIMENT

Figure 1:
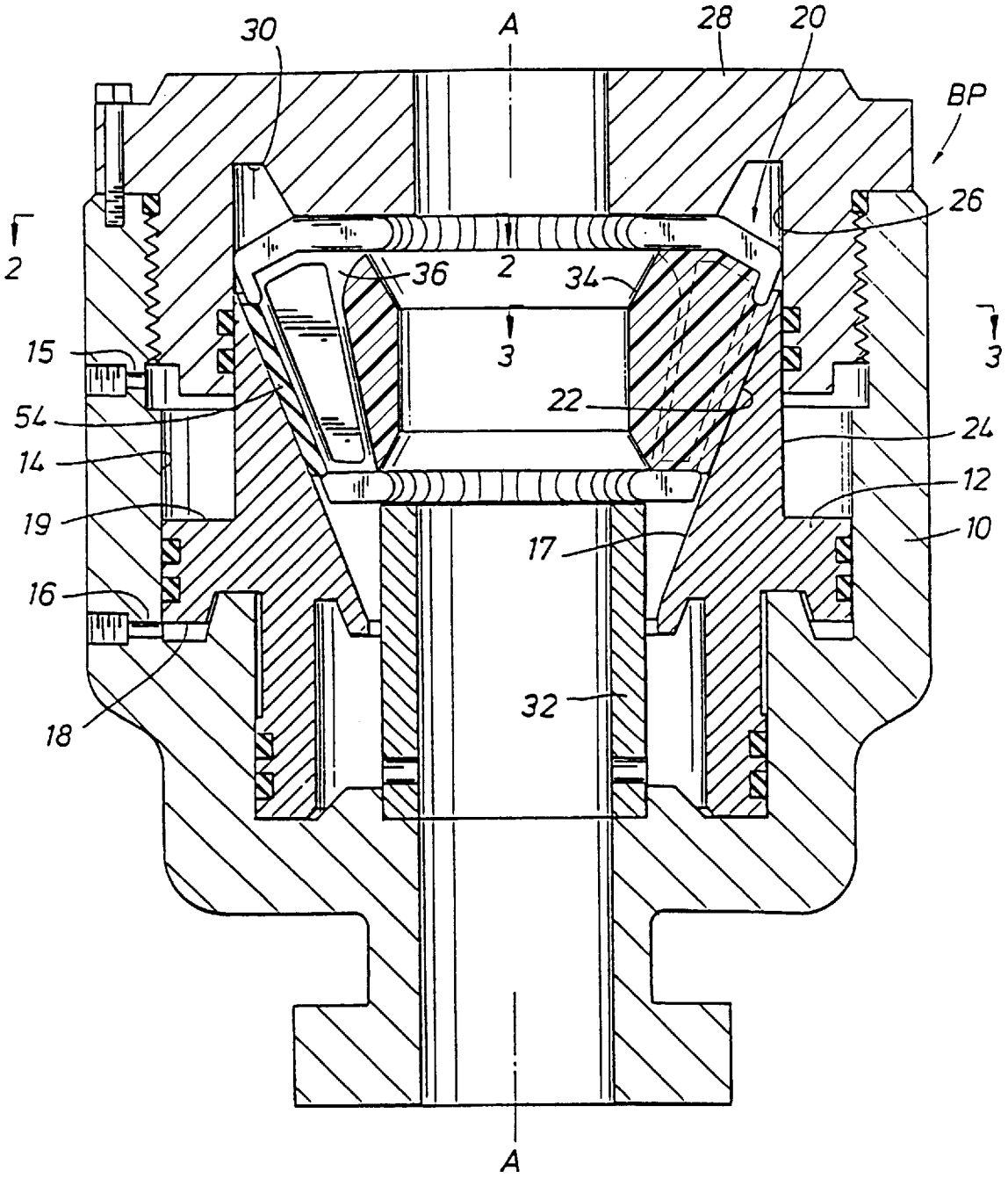
FIG. 1 is an elevational view, in cross-section, of an annular blowout preventer having a packing element in accordance with the present invention.

FIG. 1 illustrates annular blowout preventer BP including metallic housing 10, the lowermost portion of which is flanged for bolting to a well head casing flange or other well head equipment such as a ram-type blowout preventer in a stack. The housing includes piston actuator 12 movable upwardly within chamber 14 in response to fluid pressure exerted through opening 16 against lower face 18 of the actuator.

Upward movement of the actuator constricts annular packing element 20 made of an elastomeric material, preferably a proven rubber compound having a durometer hardness of about 75 Shore A, through pressure directed radially inwardly from the actuator's inner cam surface 17 against exterior surface 22 of packer 20. The engaging actuator and packer surfaces are frusto-conical in shape and are flared upwardly. Upon sufficient inward radial compression, the packing element forms a seal about a well pipe (not shown) extending vertically through the blowout preventer generally along central axis A—A of the preventer. In the absence of well pipe extending through the preventer, the packer will be actuated to completely close off the vertical passage through the preventer when sufficiently constricted by piston actuator 12.

Downward movement of actuator 12 in response to fluid pressure applied through opening 15 to upper surface 19 of the actuator permits packer 20 to expand radially outwardly to its open position. Fluid pressure for inducing movement of the actuator is provided through pressure lines that communicate the fluid via openings 15 and 16 to chambers adjacent the respective upper and lower surfaces.

The piston actuator has outer annular surface 24 disposed for guided sliding engagement with bore 26 of cap portion 28 of the blowout preventer housing. Upward vertical movement of actuator 12 is limited by interior surface 30 of housing cap 28. The packing element is positioned so that its lower surface rests slightly above the top of vertical sleeve 32 when actuator 12 is in the down position.

In accordance with the present invention, packing element 20 has annular body of rubber material 34 disposed about central axis A—A of the blowout preventer, and is adapted to be constricted or compressively displaced inwardly towards the central axis. The annular body includes a plurality of equally and circularly spaced metal inserts 36 embedded in the body of rubber material about the central axis.

Inserts 36 are adapted to move with the rubber material as the material is forced toward the center of the preventer by actuator 12, and are preferably positioned in the rubber at the time of molding annular body 34. The inserts are made of steel, but other rigid materials are similarly suitable. The inserts are bonded to the rubber material by the use of a suitable adhesive during the molding process.

Referring now to FIGS. 2–7, each metal insert 36 is provided with upper and lower generally wedge-shaped flanges 38, 40 and connecting vertical web 42 attached to and extending between the flanges in generally inclined fashion at a slight angle to the axis of the opening through the preventer. Each web has a generally flat sided or planar flange-connecting rib 44 extending between and connected to the upper and lower flanges and positioned in a radial plane extending from the axis of the preventer. The web further includes arcuate edge portions 46 and 48 that are circular, or at least semi-circular in cross-section and integrally connected to the edges of the flat sided rib member. Thus, as seen in FIGS. 3 and 7, web 42 of each insert exhibits a dumbbell shaped cross section, somewhat like a an I-beam in structure, that efficiently reduces the volume of metal embedded in the body of elastomeric material 34. In other words, the shape of the web portion permits the reduction of the insert volume in packer 20, while providing sufficient load bearing reinforcement for the annular body through the advantageous geometry of the web.

Arcuate edge portions 46, 48 of each insert web provide relatively large areas at the leading and trailing surfaces of each insert in the packer for greater distribution of the forces applied to the bond line between insert 36 and rubber material 34 in the packer. Thus, the shape of the leading and trailing edges of the insert reduces the stress concentration at those surfaces, in comparison to the prior art structures, and thereby reduces the resulting strains in that region of the packing element. In this fashion, the stress imposed on rubber material 34 when the rubber material is forced into position to seal the opening through preventer BP is reduced.

As indicated above, upward movement of piston actuator 12 cause a radial constriction of packer 20, resulting in an elastic flowing or extruding of the rubber material in annular body 34. The direction of the extrusion is primarily radially inward, because upper and lower flanges 38, 40 confine the rubber against vertical extrusion. As shown in FIGS. 1 and 2, the only vertical extrusion of the rubber occurs within spaces 50 between the flanges of adjacent inserts, and outwardly of the outer ends of the flanges at 54 in the annular body.

The packing element of the present invention is adaptable to numerous bore conditions and sizes. For example, the amount of rubber displaced radially inward in any given horizontal plane of the annular rubber body for a given unit of piston travel and with a given degree of packer-taper, depends on the relative ratio of the outside and inside diameters of annular body 34 at that plane at the start of the actuator stroke through an increment of actuator travel. Thus, it is possible to design the packing element with any desired inside and outside diameter and with chosen degrees of taper, to provide the desired sealing effects. For example, in applications having low well pressures and tubular goods of a given diameter, the outside diameter of the rubber body may be increased, with a corresponding increase in the average inside diameter of the actuator bore, so that the extent of radial constriction of the packer per unit increment of actuator travel is increased.

As stated above, upper and lower flanges 38, 40 of inserts 36 serve to control endwise flow of the rubber material in the packer, but the web components 42 of the inserts also play a part in directing the flow of rubber. Annular rubber body 34 is molded so that its outer surface 22 projects radially outwardly beyond the outer edges of the metallic inserts, so that "cushion" layer 54 of rubber is disposed between the inserts and inner wall 17 of the actuator forming a sealing surface with wall 17. As the packer is compressed inwardly by actuator 12, the average diameter of packer surface 22 is reduced, producing a displacement of the rubber material that carries metal inserts 36 inwardly via the adhesive bond between the rubber and the inserts, particularly via the rubber/metal bond line at the arcuate trailing (outer) edge 48 of the web portion of the inserts. The rubber displacement is greatest in spaces 50 between the inserts since this portion of the rubber is compressed by the inserts as they are moved together by the advancement of actuator 12, and further because the portions of the rubber lying in respective spaces 50 are furthest from the rubber/metal bond lines. The bond lines at the respective leading edges of the inserts restrict movement of the rubber ahead of the leading (inner) arcuate edges 46 of the metal web portions, producing an inward bulging of the rubber material at inner surface 52 ahead of spaces 50 when the packer is compressed.

The I-beam like geometry of the dumbbell shaped web portions provides the optimum reinforcing capabilities for a given volume of metal in packer 20. This permits a decrease in the metal volume (compared to the prior art) through the smaller volume inserts, and a corresponding increase in the volume of rubber 34 in the packer, which causes the load carried by the rubber to be distributed throughout a greater volume. This relationship, together with the reduced stress and strain produced at the bond line by the relatively large surface area at the leading and trailing arcuate edge portions 46, 48 of webs 42, leads to an increase in the number of closures that the packer can safely sustain in operation.

From the foregoing it will be seen that this invention is one well adapted to attain all of the ends and objects hereinabove set forth, together with other advantages which are obvious and which are inherent to the apparatus and structure.

It will be understood that certain features and subcombinations are of utility and may be employed without reference to other features and subcombinations. This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense.

What is claimed is:

1. Metallic inserts for use in an annular blowout preventer packing element having an elastomeric body disposed about a longitudinal axis, the body carrying the inserts in respective radial planes extending from the center of the preventer and adapted to be compressively displaced inwardly towards the axis, each of the inserts comprising:

upper and lower flanges; and a web element extending between said flanges, said web element including leading and trailing edges each having outer arcuate surfaces that are substantially semicircular for distributing the loads applied to a bond line between the insert and the elastomeric body during the operation of the packing element, and a central rib extending between the edges, the rib being thinner than the edges, whereby said web element exhibits a substantially dumbbell shaped cross section for efficient reinforcement of the elastomeric body, the shape of said web element increasing the volume of the elastomeric body and decreasing the volume of the metallic inserts in the packing element to reduce the loads applied to the bond line.

2. A packing element for an annular blowout preventer, comprising:

an annular elastomeric body disposed about a longitudinal axis and adapted to be compressively displaced inwardly towards the axis;

a plurality of metallic inserts embedded in said body in generally circularly spaced fashion in respective radial planes extending from the axis for reinforcing said body, each of said inserts comprising:

upper and lower flanges; and a web element extending between the flanges, the web element including leading and trailing edges each having outer arcuate surfaces that are substantially semicircular for distributing the loads applied to a bond line between said insert and said elastomeric body during the operation of the packing element, and a central rib extending between the edges, the rib being thinner than the edges, whereby the web element exhibits a substantially dumbbell shaped cross section for efficient reinforcement of said elastomeric body, the shape of the web element increasing the volume of said elastomeric body and decreasing the volume of said metallic inserts in the packing element to reduce the loads applied to the bond line.

3. In an annular blowout preventer having an annular elastomeric body including a plurality of equally spaced metal inserts embedded in the elastomeric body for moving with the elastomeric body as the elastomeric body is forced toward the center of the preventer to engage a tubular member extending through the preventer or to close the opening through the annular elastomeric body, the improvement comprising:

providing each metal insert with generally wedge-shaped upper and lower flanges and a connecting web attached to and extending between the flanges, the web comprising:

a generally flat sided flange connecting member extending between and connected to the upper and lower flanges and positioned in a radial plane extending from the center of the preventer;

edge portions having a circular cross-section and integrally connected to the edges of the flat sided flange;

wherein the flat sided flange is thinner than the edge portions and the web exhibits a substantially dumbbell-shaped cross-section to reduce the volume of metal embedded in the elastomeric body and the stress imposed on the elastomeric body when the elastomeric body is forced into position to seal the opening through the preventer.

* * * * *